US005960781A

United States Patent [19]

Walter et al.

[11] Patent Number: 5,960,781

[45] Date of Patent: Oct. 5, 1999

[54] OVEN EQUIPPED WITH A MOVABLE HEAT GENERATING MEANS

[75] Inventors: Dominique Walter, Saint-Denis; Thierry Moriclet, Saint-Maurice; Denis Baudequin, Pont-Sainte-Maxence, all of France

[73] Assignee: Gaz De France (G. D. F.) Service National, France

[21] Appl. No.: 09/026,152

[22] Filed: Feb. 19, 1998

[30] Foreign Application Priority Data

Feb. 20, 1997 [FR] France ..... 97 02026

[51] Int. Cl.[6] ..... F24B 3/00

[52] U.S. Cl. ..... 126/21 R; 126/41 R

[58] Field of Search ..... 126/21 R, 41 A, 126/41 B, 19 M, 41 R, 273 R, 39 L

[56] References Cited

U.S. PATENT DOCUMENTS

| | | | |
|---|---|---|---|
| 1,543,212 | 6/1925 | Kurrell et al. | 126/41 A |
| 2,070,111 | 2/1937 | Blayney | 431/347 |
| 2,578,227 | 12/1951 | Chambers | 126/41 |
| 2,782,779 | 2/1957 | Chambers | 126/39 |
| 2,848,592 | 8/1958 | Mergen | 219/35 |
| 3,132,231 | 5/1964 | Montgomery | 126/19 M |
| 4,416,249 | 11/1983 | Reynolds et al. | 126/41 R |
| 4,781,170 | 11/1988 | Perl | 126/39 E |
| 4,805,587 | 2/1989 | Schweitzer | 126/39 L |
| 5,758,635 | 6/1998 | Petersen | 126/25 A |

FOREIGN PATENT DOCUMENTS

| | | | |
|---|---|---|---|
| 256475 | 7/1912 | Germany | 341/10 |
| 378316 | 7/1923 | Germany . | |
| 826060 | 7/1949 | Germany . | |
| 9116603 | 4/1993 | Germany . | |
| 103919 | 2/1917 | United Kingdom . | |
| 482482 | 3/1938 | United Kingdom . | |

*Primary Examiner*—Ira S. Lazarus
*Assistant Examiner*—Donna Mann
*Attorney, Agent, or Firm*—Rothwell, Figg, Ernst & Kurz, P. C.

[57] ABSTRACT

An oven, including an inner compartment comprising side walls, a lower wall, an upper wall and a back, an outer compartment defining a casing and surrounding the inner compartment in order to delimit therewith a continuous intermediate space, a heat generating device for producing heat by conduction, convection or radiation connected to the casing and mounted between the inner compartment and the outer compartment, a source of energy, with the exception of sources of microwaves, connected to the heat generating device and intended to generate the heat, and at least one heating zone, opposite which is situated the heat generating device, the heat generating device is mounted so as to be movable relative to the casing and to the heating zone, wherein the two compartments are substantially concentric and the heat generating device is mounted so that the heat generating device rotates between the inner compartment and the outer compartment.

18 Claims, 6 Drawing Sheets

OVEN EQUIPPED WITH A MOVABLE HEAT GENERATING MEANS

BACKGROUND OF THE INVENTION

1. Field of the Invention

The field of the invention relates to heat generating means used in heating and/or cooking appliances, comprising:

a casing, at least one means, connected to the casing, for generating heat by conduction, convection or radiation, a source of energy, with the exception of sources of microwaves, connected to the heat generating means and intended to supply the latter in order to generate heat, and at least one heating zone opposite which is situated the heat generating means.

2. Description of the Background Art

In the description which follows, it is considered that a heating zone is a zone of the heating and/or cooking appliance which is capable of being heated by the heat generating means when it is located opposite the latter.

In the general field of heat generating means for heating and/or cooking appliances, in particular for the kitchen (industrial or domestic), the electrical resistance or the burner are already known, both fixed with respect to the said appliance and connected to a source of energy (electricity, gas, fuel, etc.). Sometimes the heat producing means is coupled to a supplementary means for diffusing the generated heat, such as a fan, in order to distribute the heat A principal problem with all of these appliances is that they prove imperfect or inappropriate when there is a need to vary the location of the heating zone or even to homogenise the heat generated without having recourse necessarily to the fan or to an equivalent means. Moreover, if the heating appliance is substantial, one single heat generating means is frequently insufficient, which means in particular either increasing its power or increasing the number of heat generating means and distributing them over different zones to be heated, and the control and/or the cost of manufacture and use rapidly becomes prohibitive.

The present invention therefore proposes a solution to at least some of these drawbacks, by proposing a heating and/or cooking appliance of the type already described, characterised in that the heat generating means is movable relative to the casing of the heating zone(s).

SUMMARY OF THE INVENTION

According to a first idea, the heat generating means can in particular be connected to a support mounted so that it turns relative to the casing opposite the heating zone in order to obtain a movement of the heat generating means which is easy to carry out and to control and which particularly favours a homogeneous distribution of the heat thus generated.

In order to generate heat by radiation and for this heat to be generated in a uniform manner, the heat generating means can be equipped with at least one element having a radiant surface which is movable therewith in order to radiate towards the heating zone.

According to another idea linked to economy of use and flexibility of heating, the energy source to which the heat generating means is connected will advantageously be a mixture of combustible gas and combustive air, and the heat generating means will then include at least one burner.

In order to increase if need be and to favour the homogenisation of the heat generated by the heat generating means, the apparatus may also include a fixed element having a radiant surface opposite which the heat generating means is disposed in a predetermined position thereof to radiate, in this position of the heat generating means, towards the heating zone(s).

The principal characteristic set out above (heat generating means movable with respect to the casing and to the heating zone) may also be applied to an oven of the "food oven" type, particularly for use in a kitchen (industrial or domestic), the said oven comprising:

an inner compartment, an outer compartment defining a casing and surrounding the said inner compartment in order to create therewith a continuous intermediate space, a means for generating heat by conduction, convection or radiation connected to the said casing, a source of energy, with the exception of sources of microwaves, connected to the said heat generating means and intended to generate the said heat, and at least one heating zone, opposite which is situated the heat generating means, the said oven being characterised in that the heat generating means is movable relative to the casing and to the heating zone(s).

According to a first idea, the heat generating means will preferably be disposed between the inner compartment and the outer compartment of the oven. In this way, the interior of the inner compartment is heated externally and the heat generating means does not hamper the introduction of a receptacle or of food to be cooked or to be heated in the inner compartment of the oven.

In order to facilitate the movability of the heat generating means between the two compartments, these latter may be substantially concentric and the heat generating means is mounted so that it turns between them.

According to a complementary idea, the heat generating means extends in the direction of the depth of the oven, that is to say between the back and the front part of the inner compartment (in the normal position of use). In this way, the majority of the heating zone and the space between the two compartments are heated.

In the particular field of heat generating means for appliances for heating and/or for cooking food which are used in particular in kitchens (industrial or domestic), the traditional gas oven is already known which comprises a first compartment inside which is placed the food to be cooked or reheated (itself placed if need be in a suitable receptacle), the interior of the said compartment being heated with the aid of one or two gas manifolds disposed below the floor and below the roof (grill position). In general, these manifolds have the shape of a flat coil with meanders providing substantially uniform heating under the floor (cooking mode) and/or under the roof (grill mode). Nevertheless, these heat generating means have various drawbacks amongst which may be mentioned:

ignition is done at two different points (one per manifold), sometimes more according to the size, the shape and the arrangement of the coil(s);

the flame detection is also multiplied because it depends upon the number of gas manifolds;

it is impossible to create what is called "rotating heat", the heating being concentrated in two particular zones (floor and roof);

it is impossible to achieve pyrolysis of the oven in order to clean it of grease by incineration at high temperature.

Thus according to one idea associated with at least some of these drawbacks, with the flexibility of use and the rapidity of heating, the energy source to which the heat generating means is connected is a mixture of combustible gas and combustive air, and the heat generating means comprises at least one burner supplied with the said gas mixture.

The inner compartment preferably comprises side walls, a lower wall, an upper wall and a substantially vertical back in the normal position of use, and the heat generating means turns by at least 180° about an axis xx' perpendicular to the said back. In this way, the heat generating means will be able to turn around the inner compartment in order to offer the possibility of achieving the cooking mode in a fixed position below the lower wall, the grill mode in a fixed position above the upper wall, the rotating heat mode in a position where it is movable around the compartment at constant speed, and the pyrolysis mode in slow rotation around the inner compartment at maximum heating power.

In order to avoid heating the compartments until red-hot, the burner may comprise a row of outlet holes for the ignited gas which are aligned according to an axis zz' parallel to the axis xx', and the said outlet holes for the ignited gas can be situated laterally on the burner in such a way that the flames coming from the burner do not develop in the direction of the inner and outer compartments.

According to another idea, the outer compartment may be equipped with a metal plate disposed above the upper wall of the inner compartment, which may then be constituted in part by a material which is transparent at least to infrared rays, typically glass ceramic material. Thus the burner will heat the metal plate until it is red-hot when it is in the fixed position known as the "grill position", and the said plate then emits infrared rays which pass through the part of the upper wall which is transparent to the rays in order to heat the interior of the inner compartment According to yet another idea, the heat generating means or one of the heat generating means may be mounted so as to turn about an axis yy' perpendicular to the lower wall of the inner compartment In this way the heat generated by the heat generating means will be more homogeneous below the lower wall for the cooking mode, or above the upper wall for the grill mode.

According to a complementary aspect, the heat generating means may be equipped with at least one element having a radiant surface which is movable therewith in order to radiate towards the heating zone.

The invention also relates to a cooker comprising:

a casing equipped with an upper plate, a means for generating heat by conduction, convection or radiation connected to the said casing, a source of energy, with the exception of sources of microwaves, connected to the said heat generating means and intended to supply the latter in order to generate the said heat, and at least one heating zone, opposite which is situated the heat generating means, characterised in that the heat generating means is movable relative to the casing and to the heating zone(s).

According to a first idea, the one or several heat generating means may be connected to a means for displacement in translation enabling it or them to be placed away from the heating zone(s) and/or to be displaced between several heating zones. In this way, it will be possible to avoid having to move a receptacle or food placed over its corresponding heating zone, which will enable each heating zone to be heated alternatively. It will also be possible to use several heat generating means with different power (cooking, simmering) displaced alternately in order to heat one and the same receptacle without having to move the latter.

According to another idea which may be complementary to the preceding one and is associated with the reduction of the manufacturing costs, whilst taking advantage of the movability of the one or several heat generating means, the number of heating zones will be at least equal to two and will be strictly greater than the number of heat generating means. Thus it will be possible to have one single heat generating means for two heating zones or more, the said (each) heat generating means being movable with respect to these heating zones so as to come if need be to heat alternately the receptacles or food placed on these zones.

BRIEF DESCRIPTION OF THE DRAWINGS

The invention and its implementation will become apparent even more clearly with the aid of the description which follows, with reference to the accompanying drawings in which.

DETAILED DESCRIPTION OF THE PREFERRED EMBODIMENTS

Figure 1:
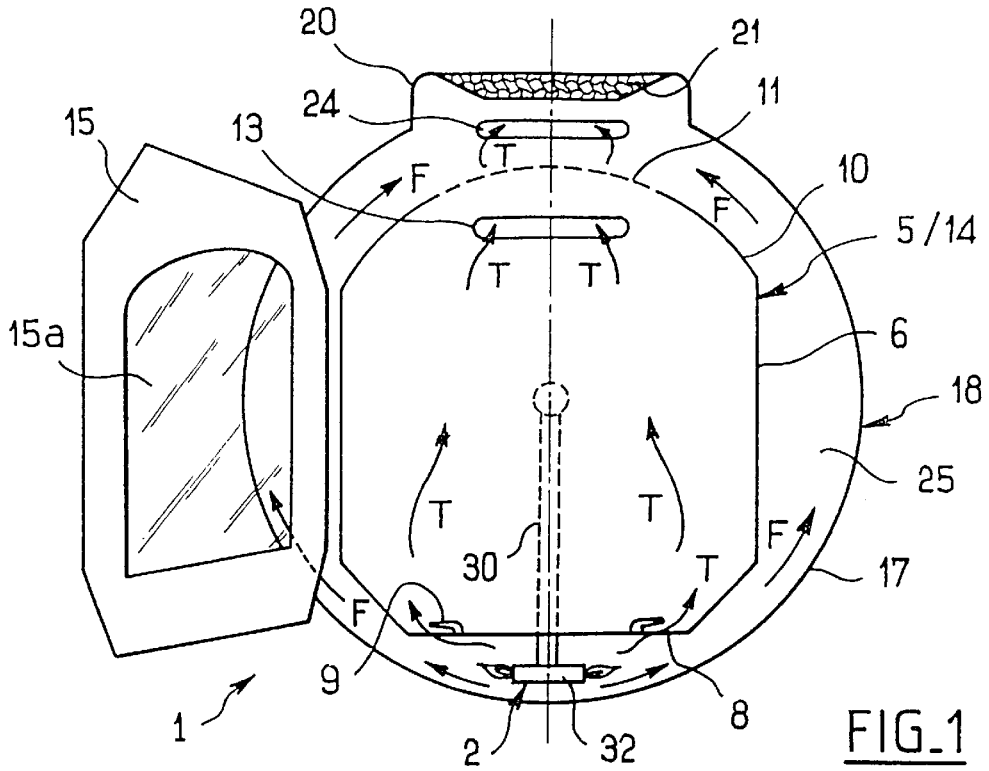
FIGS. 1 and 3 show diagrammatic front elevations (from the front) of an oven equipped with the heat generating means disposed in two different positions.

An oven 1 equipped with a heat generating means 2 according to the present invention is shown in FIG. 1. This oven 1 comprises an inner compartment 5 produced from a metallic material which is a good conductor of heat and is relatively thin such as sheet steel. The inner compartment 5 comprises substantially planar and parallel side walls 6, a substantially planar lower wall 8 (called the "floor") equipped with vents 9 opening into the inner compartment 5, an upper wall 10 (called the "roof") in the form of a dome comprising at least one part 11 which is transparent to infrared rays, typically made from glass ceramic material, and a substantially planar back 12. The back 12 and the side walls 6, on the one hand, and the lower wall, on the other hand, are normally essentially vertical and horizontal respectively in the normal position of use of the oven 1. The back 12 is also equipped with an elongated opening 13 placed close to the upper wall 10, the greater dimension of this opening being parallel to the lower wall 8. In order to simplify the description, the inner compartment 5 will constitute all or part of a heating zone denoted by the reference 14. A front 15, of which a part 15*a* at least is made from a transparent material which is resistant to temperatures higher than 400° C. such as special glass of a composition which is known for this type of application, permits the inner compartment 5 to be closed frontally.

It may also be seen that the oven 1 is equipped with an outer compartment 17 which defines at least a part of a casing 18 and is disposed around the inner compartment 5. The two compartments will preferably be disposed coaxially. The outer compartment 17 is preferably of generally circular cylindrical shape and is provided with an upper stand-off 20 inside which is fixed a metal plate 21 intended to be heated until red-hot by the heat generating means 2 when this latter is in a low static position below the plate 21. The inner compartment 5 and the outer compartment 17 define a space 25 inside which the heat generating means 2 illustrated in FIG. 4 may move. A substantially annular front plate 22 permits the said space 25 to be closed off at the front of the oven. The outer compartment 17 also comprises a back 23, typically a metal plate parallel to the back 12 and having substantially the shape of a disc. This back 23 is also equipped with an elongated opening 24 which has substantially the same dimensions as the opening 13 and is placed slightly above the upper wall 10 of the inner compartment 5.

Figure 2:
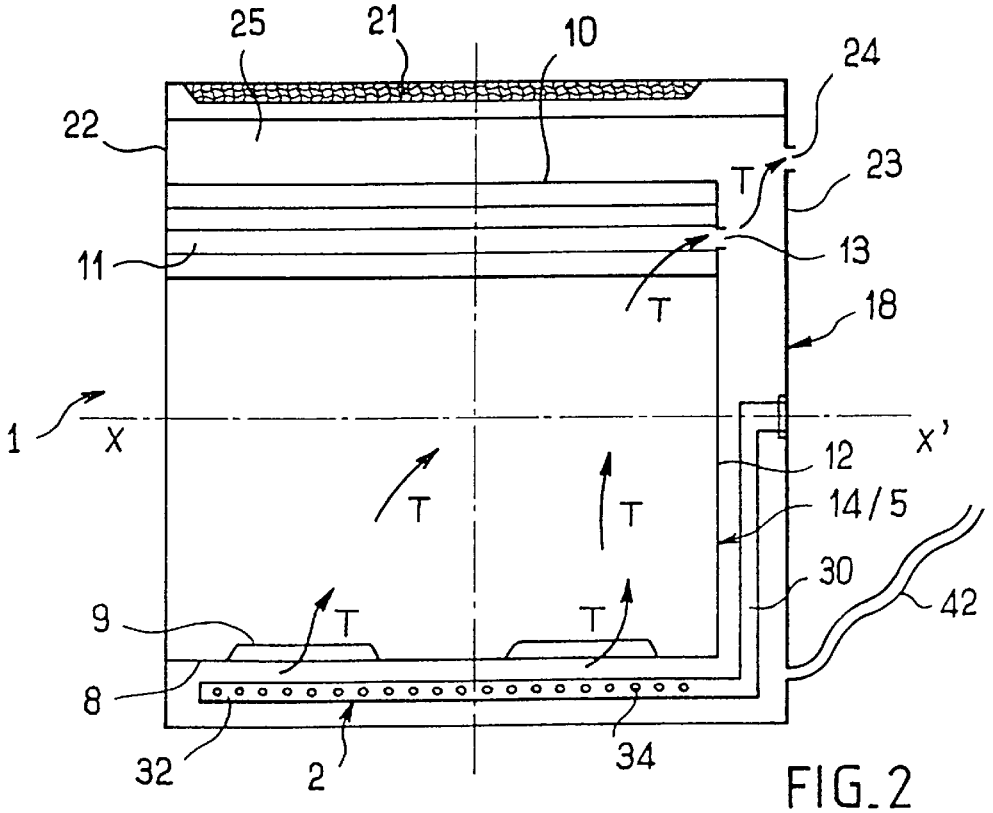
FIG. 2 shows a diagrammatic side view in section of FIG. 1.
Figure 4:
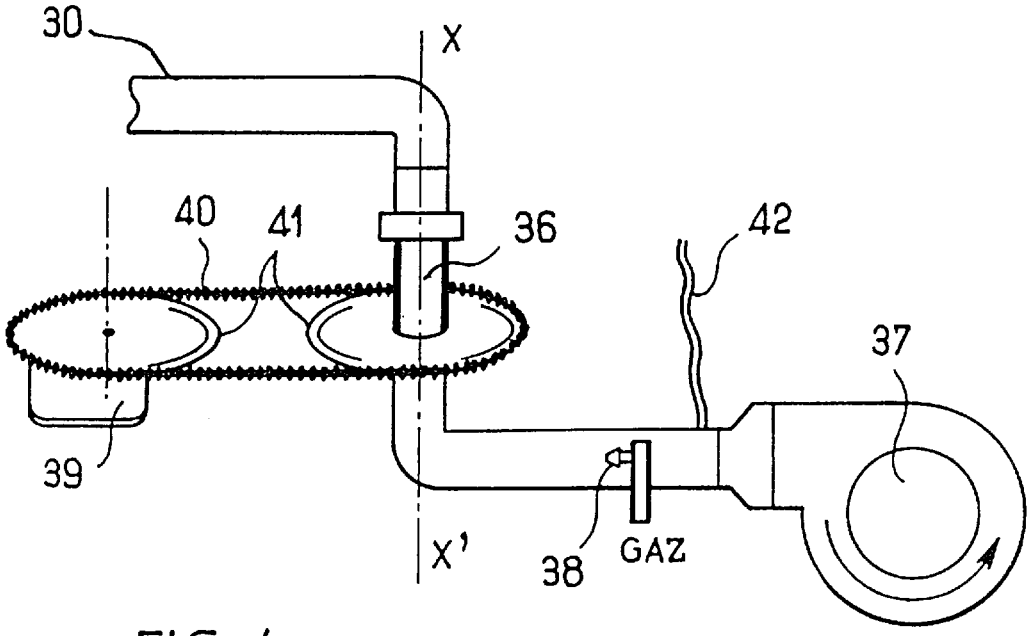
FIG. 4 shows a detail of the system for rotating the heat generating means and for supplying it with energy.

In FIG. 2, the oven 1 is seen in section from the side with the heat generating means 2 in a low static position (cooking mode) below the lower wall 8. The outer compartment 17 has a horizontal axis xx' perpendicular to the back 23 at a point about which a support 30 turns which is connected to the said back 23 and is in the shape of an "L". On this support 30 is fixed a burner 32 for a gas mixture, which can also be seen from the front in FIG. 1, the said burner 32 acting as heat generating means 2 for the oven 1, of the blue flame type. It will be recalled here that a blue flame is a so-called "heating" flame, in contrast to the yellow flame which is a so-called "luminous" one. This burner 32 is substantially in the form of a hollow rod which extends according to the depth of the oven (parallel to the axis xx') and is equipped with at least one combustion manifold 33 (see FIG. 5), and preferably two, which are opposed and supplied with a mixture of combustible gas and combustive air, as is represented in FIG. 4. As illustrated by the arrows F shown in FIG. 1, it will be seen that the said heat generating means 2 can turn on its support 30 about the axis xx' by at least 180°, and preferably by 360°, between the inner compartment 5 and the outer compartment 17, by virtue of a motor 39 which is itself shown in FIG. 4.

Figure 3:
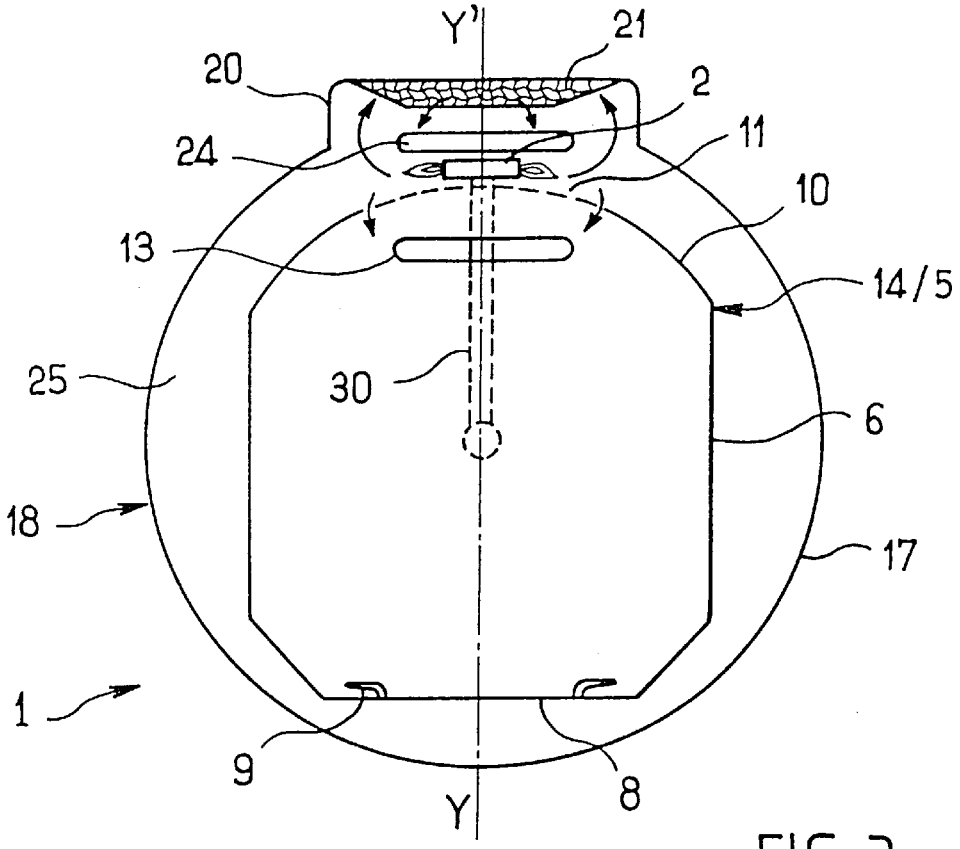

FIG. 3 shows the oven 1 with the heat generating means 2 in a fixed position above the upper wall 10. This position is also called the "grill" position or grill mode because the burner 32 heats the metal plate 21 placed above the heat generating means 2 and heats it until red-hot in order that it should emit infrared rays which pass through the transparent zone 11 of the upper wall 10 in order to heat the interior of the inner compartment 5. In this way, food placed inside the compartment, and in particular close to the upper wall 10, can be grilled.

FIG. 4 shows in detail the system which enables the burner 32 to be supplied and enables the support 30 to be turned. For this, the support 30 is hollow and is connected to a pipe 36 inside which circulates air which has been pressurised by a fan 37 and combustible gas (such as natural gas) supplied downstream of the fan 37 via an injection duct 38. The support 30 is mounted so as to turn on its axis xx' and is connected to the motor 39 with the aid of sprocket wheels 41 and a chain 40. The system for supplying the burner 32 and the system for rotating the support 30 are mounted behind the back 23. Some of the air supplied by the fan 37 may be diverted in the direction of the space 25 by a pipe 42 (see FIG. 2) and displaced between the inner compartment 5 and the outer compartment 17 as illustrated by the arrows T shown in particular in FIGS. 1 and 2.

Figure 5:
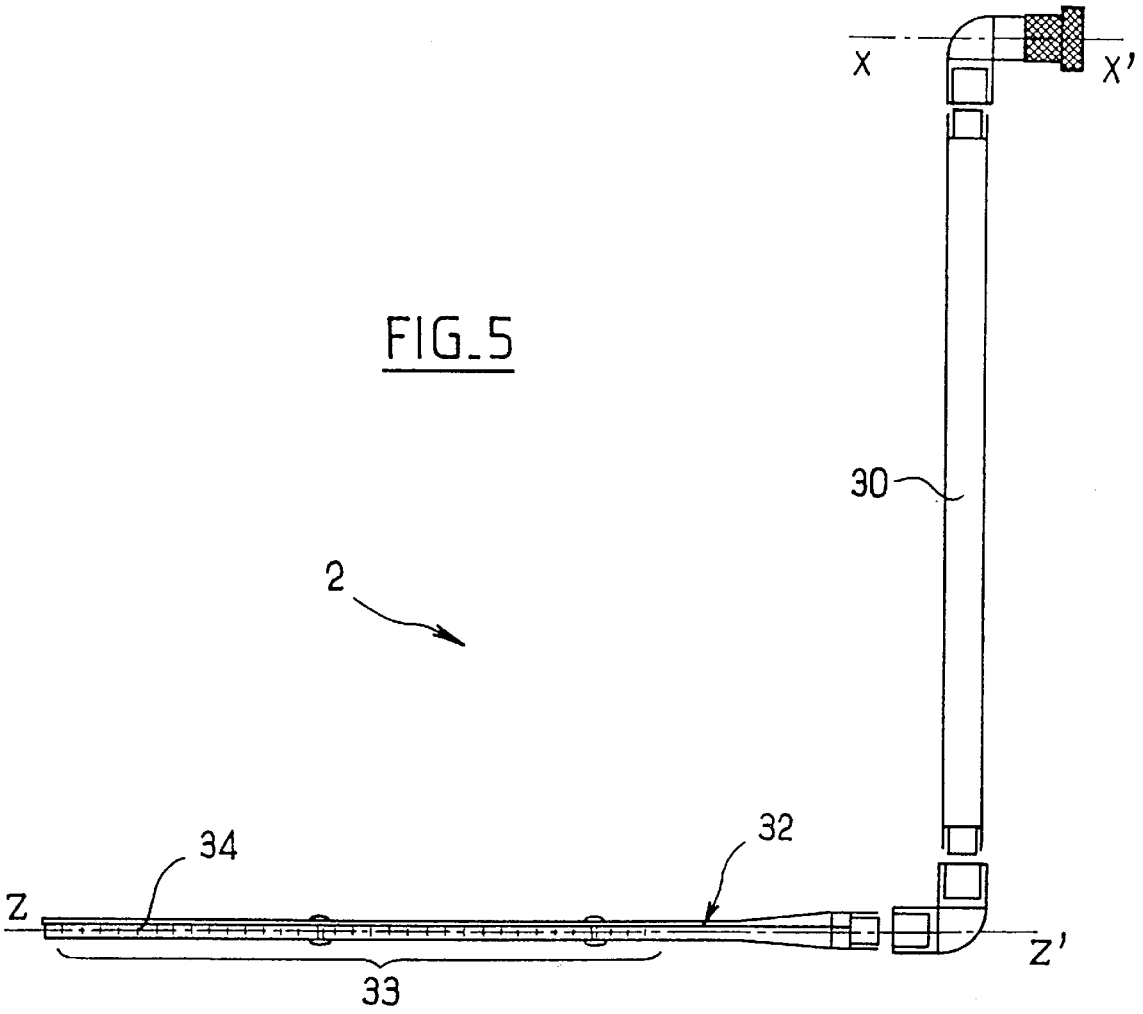
FIG. 5 shows a detail from the side of the heat generating means.

The burner 32 and its arm 30 which is movable about the axis xx' can be seen in greater detail in FIG. 5. In particular it will be seen that the burner 32 comprises at least one lateral manifold 33 provided with a series of holes 34 aligned according to an axis zz' parallel to the axis xx'. These holes 34 are intended for the passage of the ignited gases, the air/gas mixture functioning in total air pressurised by the fan 37. It may be noted, particularly when observing FIGS. 1 and 3, that the flames (preferably categorised as "blue flames") coming out of the holes 34 are not directed against the two compartments. On the contrary, they are substantially tangential to the upper wall 10 when in proximity to the upper wall 10, and parallel to the side walls 6 and lower wall 8, when in proximity to the side walls 6 or the lower wall 8, in order to avoid the compartments 5 and 17 being heated until red-hot, whilst sufficiently heating the heating zone 14 so that it in turn heats the interior of the inner compartment 5.

Thus it is clear that the heat generating means 2 can take up all of the possible positions in rotation between the two compartments. In particular, it can be kept below the lower wall 8 of the inner compartment 5 (FIG. 2) in order to heat the bottom part of the heating zone 14 (floor element of the oven); this is conventional cooking. It may be noted that the heat evolved by the heat generating means 2 then passes through the vents 9, is displaced vertically by convection inside the inner compartment 5 according to the arrows T in order to heat or cook food placed inside the latter, and passes through the vent 13 then the vent 24 to re-emerge behind the oven 1.

The heat generating means 2 can also be kept above the upper wall 10 of the inner compartment 5 (FIG. 3), and heat the metal plate 21 in order to make it red-hot, the infrared rays thus created then passing through the transparent part 11 of the said upper wall 10 in order to heat the interior of the inner compartment 5; this is the grill or griller mode effected here by radiation (infrared), then by convection inside the inner compartment 5.

A third mode, known as "rotating heat", is also proposed, this being important and unprecedented in this type of oven. For this, the support 30 turns about the axis xx' by virtue of the motor 39 (shown in FIG. 3) which drives it In this way the heat generating means 2 turns around the inner compartment 5 according to the arrows F (FIG. 1) in order to heat the heating zone 14, and flames emerge laterally from the opposing manifolds 33 through the holes 34 without contact with the compartments. The rate of rotation of the arm 30 can be regulated with the aid of the motor 39, and will preferably be about 2 turns per minute for a homogeneous distribution of the heat. It is also possible to provide for a diversion of the air originating from the fan 37 in the direction of the empty space 25 via a pipe 42 (FIG. 2), in such a way that the heat emitted by the heat generating means 2 circulates between the two compartments and inside the inner compartment 5 through the vents 9, 13 and 24, as the arrows T in FIG. 2 show.

Another mode is also provided: this is pyrolysis. For this, it is arranged for the temperature inside the oven 1 to be about 480° C. by putting the burner 32 at full power, and the heat generating means 2 is allowed to turn at a relatively slow speed (less than 1 turn per minute). Thus a complete pyrolysis can be effected in one hour by incineration of the grease attached to the inner compartment 5, whilst the same operation takes between two and three hours in a traditional electric oven and consumes more energy.

Figure 6:
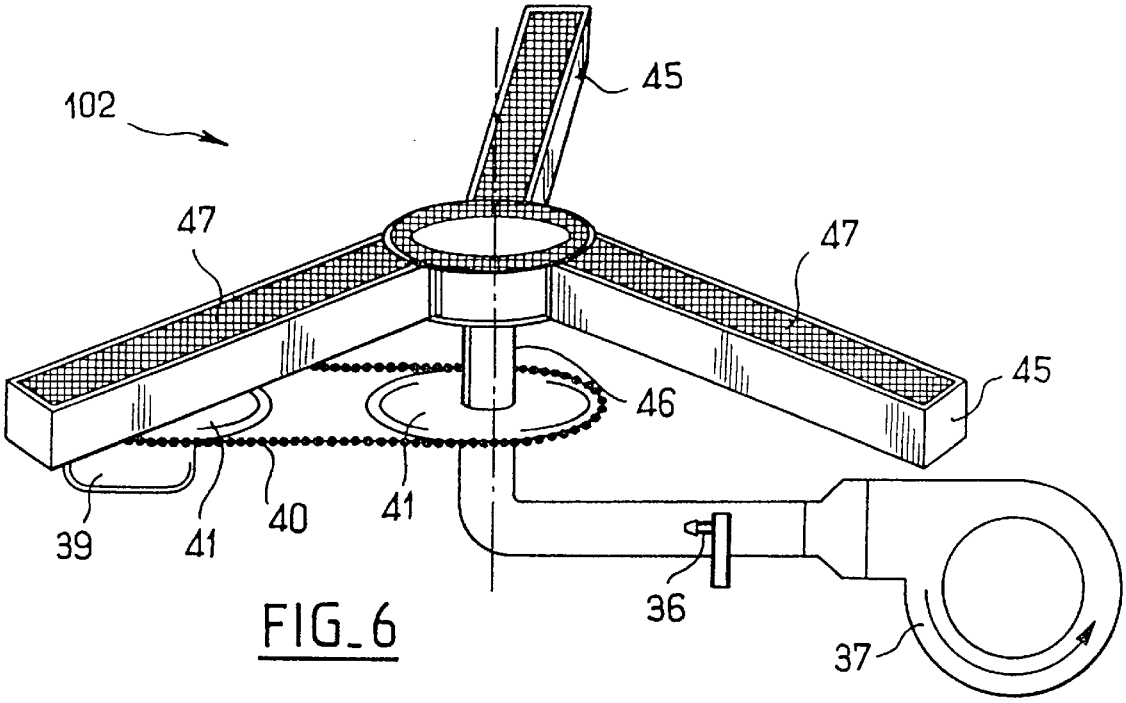
FIG. 6 shows a diagrammatic perspective view of a variant of the construction of the heat generating means.
Figure 7:
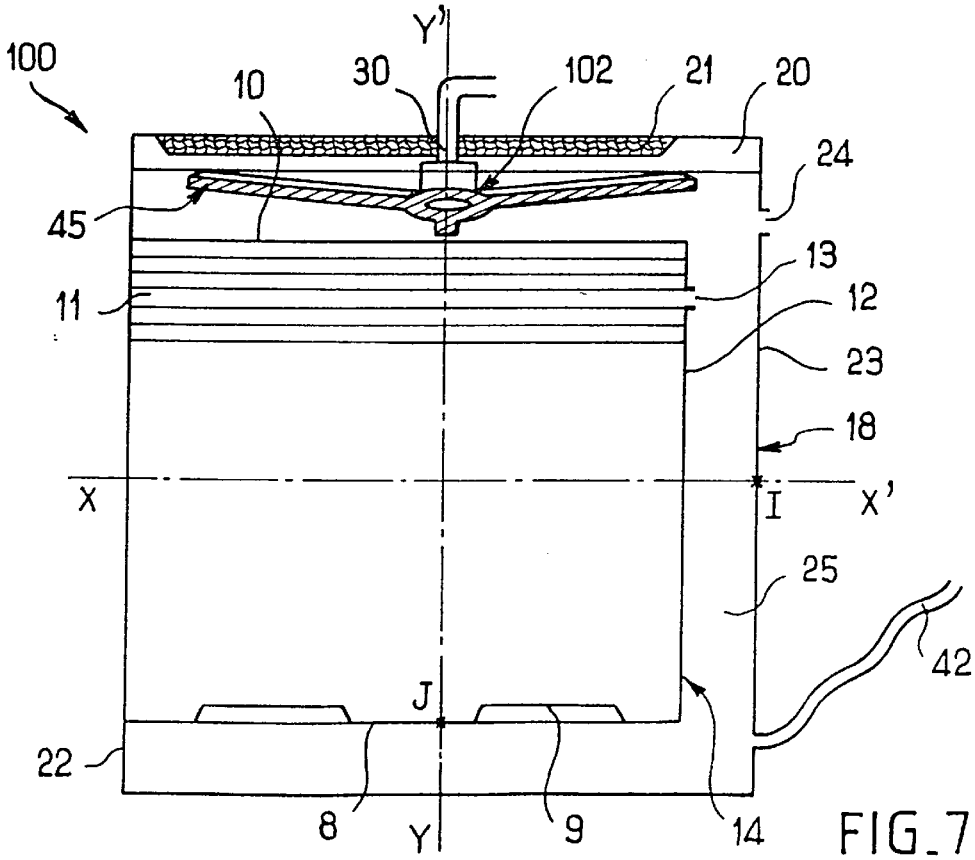
FIG. 7 shows a diagrammatic sectional view of an appliance equipped with the heat generating means according to FIG. 6.

FIGS. 6 and 7 show a variant of the construction of the heat generating means 102 for an oven 100 (also called a "grill") having an identical structure to the oven 1. In order to facilitate the description, the parts of the oven 100 which are identical to those of the oven 1 will bear the same references. The heat generating means 102 comprises at least one burner 45 in the form of a vane, and preferably three, disposed at 120° with respect to one another and mounted so as to turn on a shaft 46. These vanes are supplied with combustible gas and with combustive air in order to create an ignited mixture. The rotation of the heat generating means 102 does not take place around the inner compartment 5 but above the upper plate 10 in "grill" mode rotation is about an axis yy' orthogonal to the preceding axis xx' and perpendicular to the lower wall 8 at a point J. Each burner 45 preferably comprises at least one radiant zone 47 of fibrous refractory material of the randomly braided ceramic fibre type. Thus there is no flame coming out of the heat generating means 102, since this latter heats by radiation. The supply and rotation system of this variant of the construction is identical to that of the heat generating means 2 of FIGS. 1 to 5, but it is fixed inside the stand-off 20 of the outer compartment 17, replacing the metal plate 21.

Figure 8:
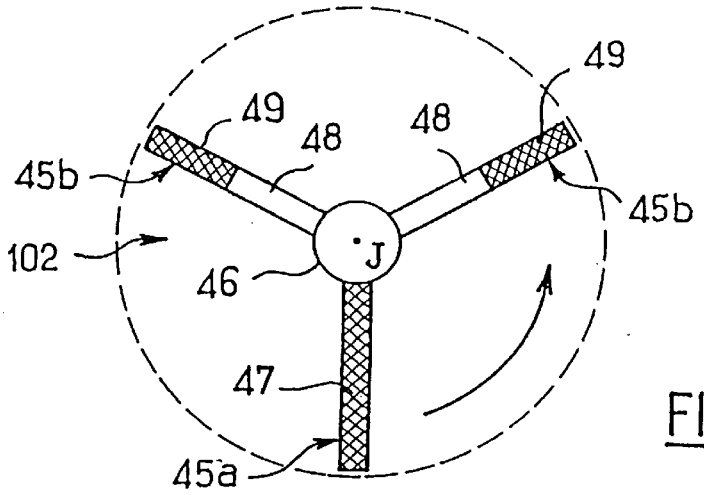
FIGS. 8 to 10 show variants, seen diagrammatically from above, of the central part of the construction illustrated in FIG. 6.
Figure 9:
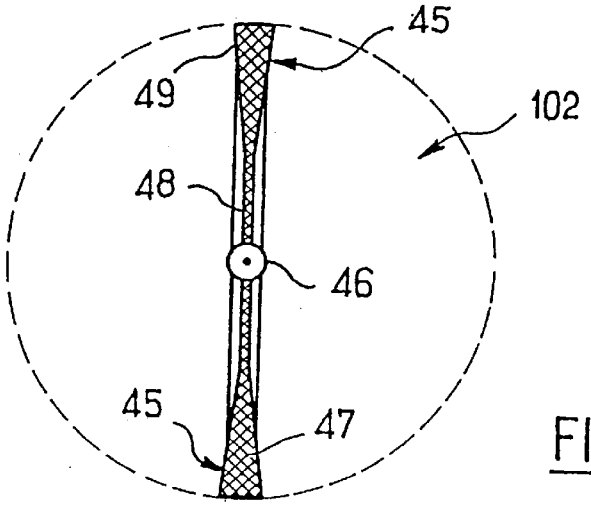
Figure 10:
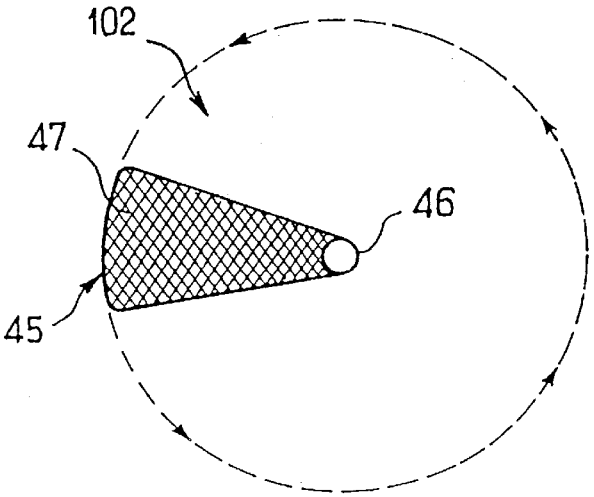

Different variants of the construction of the heat generating means 102 of FIG. 6 are illustrated in FIGS. 8 to 10. For all these variants of the construction, the basic principle is retained, namely to make the heat generating means 102 turn about an axis yy' between the inner compartment 5 and the outer compartment 17, above the upper wall 10.

In FIG. 8 the heat generating means 102 consists of a burner 45*a,* the surface of which is entirely covered with fibrous refractory material forming a radiant zone 47, and two other burners 45*b* comprising a peripheral portion 49 covered by the said refractory material and a central portion 48 close to the axis of rotation yy' which does not generate any heat With this configuration, the distribution of the heat when the heat generating means 2 is in rotation is different from that obtained with the heat generating means illustrated in FIG. 6.

FIG. 9 shows a variant of FIG. 6 in which the heat generating means 102 is equipped with two burners 45. Each of these burners 45 comprises a radiant zone 47 divided into a central portion 48 close to the axis of rotation yy' and a peripheral portion 49 of a different shape. In particular, the surface of the central portion 48 is very thin and rectilinear (rectangular shape) whilst the surface of the peripheral portion 49 is of triangular shape widening towards the end furthest from the axis of rotation yy'. In this way the distribution of the heat is different and progressive from the centre towards the end of each vane 45.

FIG. 10 shows another variant of FIG. 6 in which the heat generating means 102 is equipped with only one single burner 45, the radiant zone 47 of which has a triangular shape widening from the axis of rotation yy'. Once again, the distribution of the heat is different from the variants of the construction illustrated in FIGS. 6, 8 and 9.

The principle of the grill thus illustrated in particular in FIG. 7 is relatively simple. The previously described heat generating means 102 is disposed between the outer compartment 17 and the inner compartment 5, above the upper wall 10 of which a part 11 is preferably constituted by a material which is transparent to infrared rays, typically a glass ceramic material. At the same time as the heat generating means 102 heats by radiation, this latter being obtained by the radiant zone 47, it is set in rotation by a motor 39 (see FIG. 6) which makes it turn at about two turns per minute according to an axis yy' perpendicular to the lower wall 8. In this way the distribution of the heat is homogeneous, permitting slices of bread or other food placed on a grill in the oven 1 to be grilled easily and rapidly. The infrared rays will also heat the heating zone 14, and in particular the non-transparent part of the upper wall 10. This manner of operation may also be adapted to the cooking mode by disposing the heat generating means 102 below the lower wall 8 and making it turn in the same way as previously about the axis yy'.

Naturally, the heat generating means 102 described and illustrated in FIGS. 6 to 10 can also be applied to small electrical domestic appliances for heating and/or cooking such as a vertical toaster, in which case the said heat generating means 102 is placed on the side(s) of the slices to be grilled and not above.

Figure 11:
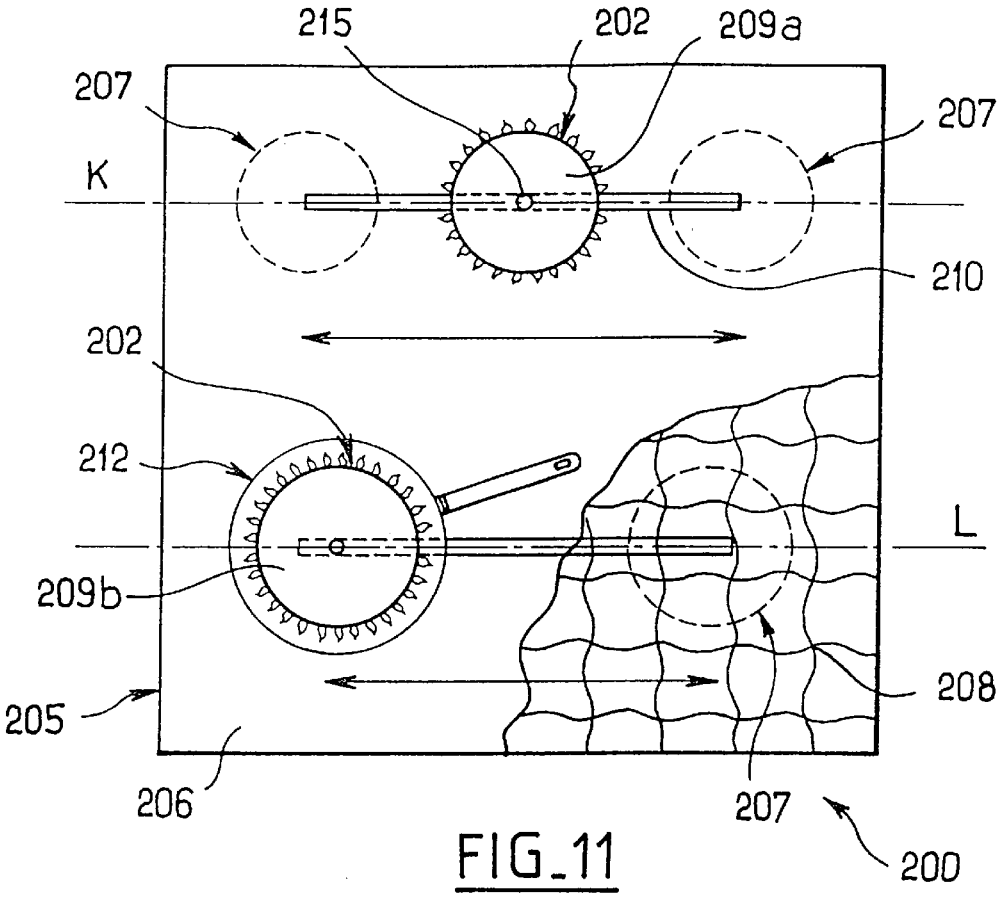
FIG. 11 shows a diagrammatic view from above of a cooker equipped with a second variant of the construction of the heat generating means.

FIG. 11 describes a variant of the construction in which at least one heat generating means 202 is disposed in a cooker 200 or in an appliance of the same type (for example a simple hob which can be built in). This cooker 200 comprises a casing 205 provided with an upper wall 206 above which is fixed here a grid 208 of a type known in this type of appliance, although a solid glass ceramic plate can also be used. This grid creates several heating zones 207 which can be indicated directly on the grid (by modification of the colour or appearance of the grid), or on the upper wall 206 (for example by screen printing). The heat generating means 202 comprises a burner 209*a* with a blue flame and of a known type connected to a foot 215 which is itself engaged on a linkage 210 (shown diagrammatically) in order to form displacement means intended to render it movable with respect to the casing 205 and to at least one of the heating zones 207. There will preferably be at least one movable burner 209*a,* and the other or others can be fixed. In FIG. 11, two heat generating means 202 are shown, each comprising a movable burner (referenced 209*a* and 209*b*). They are disposed in such a way that they can be displaced laterally respectively according to two parallel lines referenced K and L. With this solution, it is possible to concentrate the heat below one or several receptacles 212 at the same time (considered as being made from transparent glass in order to simplify the drawings and to avoid dotted lines), as a function of the number of burners, the passage from one location to another being made simply by lateral translation of each burner 209*a* or 209*b* on their respective linkage 210 with respect to the casing 205 and to the heating zones 207. A burner can then be put into operation away from the heating zones 207 so that it can no longer heat the latter or in order to permit another one to be displaced if several burners are on the same linkage. It may also be envisaged to make the burners 209*a* and 209*b* pivot in an arc of a circle about an axis perpendicular to the upper wall 206 of the cooker 200, but this solution is not shown. The use of this cooker 200 is relatively simple, and in particular makes it possible to avoid having to move heavy receptacles 212 above each of the heating zones 207 of the grid 208. Thus the burner 209*a* and/or the burner 209*b* can translate laterally along the line K/L of each linkage 210 with their respective foot 215, in order to be placed below one of the receptacles 212 placed on the grid 208. Therefore it is no longer the receptacle 212 or the food placed on the grid 208 which is displaced, but the heat generating means 202 itself which is set in translation or in rotation by mechanical means below the heating zones 207 on which the receptacle (s) 212 is (are) placed (see FIG. 12). Other variants of the construction might be imagined, notably with supplementary burners, or with a displacement in the direction of the depth of the cooker, that is to say perpendicular to the lines K and L.

Figure 12:
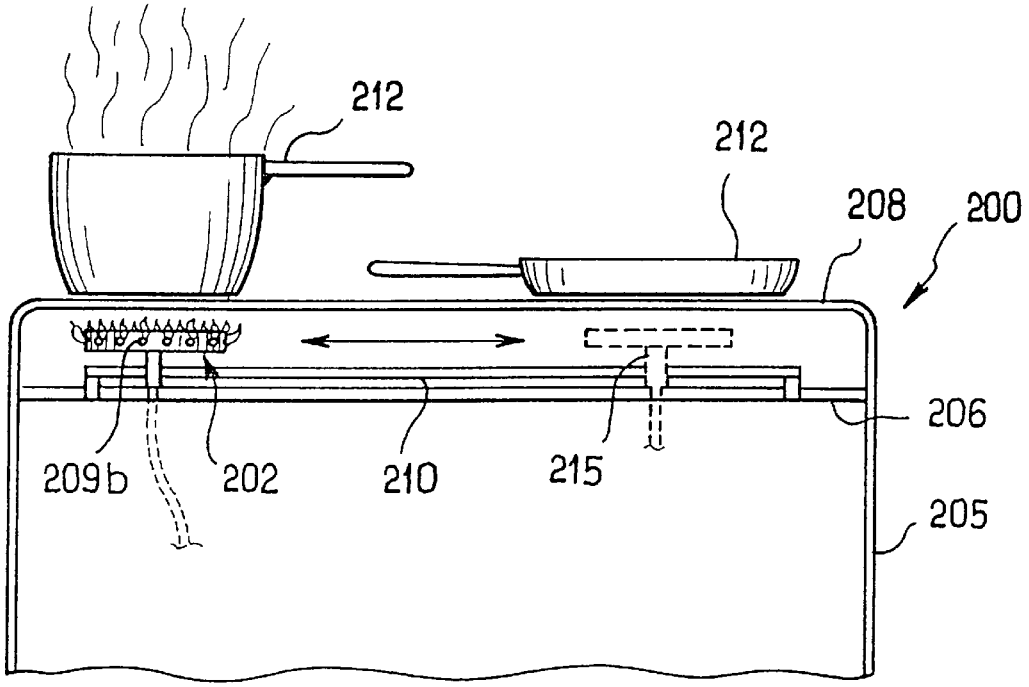
FIG. 12 shows a side view of the cooker illustrated in FIG. 11.

In FIG. 12 the cooker 200 is seen from the side, with the burner 209*b* disposed between the upper plate 206 and the grid 208 on which are disposed two receptacles 212 to be heated. The burner 209*b* can therefore move laterally along the line L in order to heat one of the two receptacles 212 from below.

Another variant of a cooker which is not illustrated may be envisaged, in which there are as many heat generating means as there are heating zones, but each heating zone can be heated by two different heat generating means (one powerful and the other weak) disposed one below the other or one beside the other on respective displacement means. Thus it will be possible to heat the same receptacle placed on a heating zone with the aid of a first heat generating means (cooking mode) and then, without moving the receptacle from its heating zone, to place the first heat generating means away from the said heating zone and to move the second heat generating means below it (simmering mode). With this solution it will also be possible to heat a first receptacle placed on a first heating zone whilst simmering the second receptacle placed on a second heating zone, then to alternate the arrangement of the burners below these two receptacles which then remain in their places. It is also possible to envisage another configuration in which the two heat generating means associated with one and the same heating zone are supplied by different sources of energy (gas and electricity) which make it possible to obtain two different types of cooking or heating alternately by alternately moving the heat generating means away from and towards the heating zone.

Figure 13:
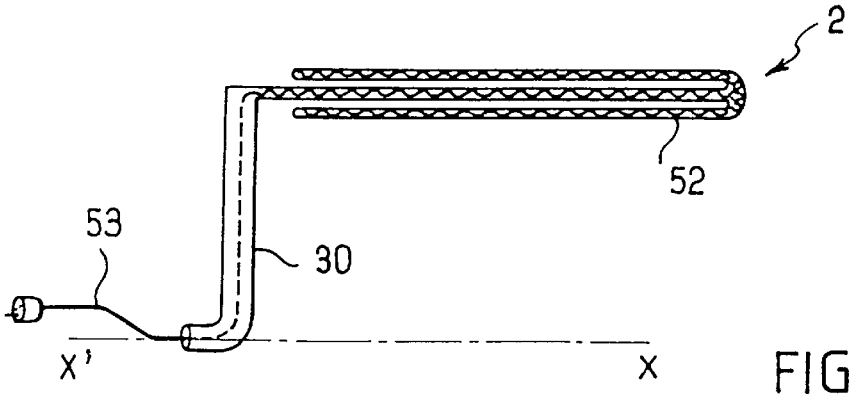
FIG. 13 is a variant of FIGS. 1 to 5 in which the heat generating means is an electrical resistance.

The heat generating means of FIGS. 1 to 5 may be different from a burner for a gas mixture. In particular, one solution proposed and illustrated in FIG. 13 provides for the use of an electrical resistance 52 supplied with electrical energy by a cable 53 passing through the support 30. In this case, the heat is essentially produced by radiation (in particular infrared), and the use of the metal plate 21 is not essential for the "grill" mode. The use of an electrical resistance in the guise of heat generating means may also apply to FIGS. 6 to 10, in which case the vane(s) is (are) replaced by one or several resistances which in particular produce the heat by radiation.

We claim:

1. An oven comprising:

an inner compartment comprising side walls, a lower wall, an upper walls and a back, an outer compartment defining a casing and surrounding the inner compartment in order to delimit therewith a continuous intermediate space, heat generating means for producing heat by conduction, convection, or radiation connected to the casing and mounted between the inner compartment and the outer compartment, a source of energy, with the exception of sources of microwaves, connected to the heat generating means and intended to generate the heat, and at least one heating zone, opposite which is situated the heat generating means, the heat generating means being mounted so as to be movable relative to the casing and to the heating zone, the inner and outer compartments being substantially concentric and the heat generating means being mounted so that the heat generating means rotates between the inner compartment and the outer compartment, wherein the heat generating means is mounted so that the heat generating means rotates by at least 180° around the inner compartment according to an axis xx' perpendicular to the back.

2. The oven as claimed in claim 1, wherein the heat generating means is connected to a support which is mounted so that the heat generating means rotates relative to the casing opposite the heating zone.

3. The oven as claimed in claim 1, characterized in that the heat generating means extends in a direction of a depth of the oven.

4. The oven as claimed in claim 1, wherein the source of energy to which the heat generating means is connected is a mixture of combustible gas and combustive air, and the heat generating means comprises at least one burner supplied with the gas mixture.

5. The oven according to claim 1, wherein the heat generating means is a burner, the burner is equipped with a row of outlet holes for an ignited gas, the outlet holes are aligned according to an axis zz' parallel to the axis xx', the outlet holes for the ignited gas being situated laterally on the burner in such a way that flames emanating from the burner develop without being in direct contact with the inner and outer compartments.

6. The oven as claimed in claim 1, wherein the heat generating means also comprises a fixed radiating element having a radiant surface opposite which the heat generating means is disposed in a predetermined position thereof to radiate, in this position of the heat generating means, towards the at least one heating zone.

7. The oven as claimed in claim 6, wherein the fixed radiating element is a metal plate used as a supplementary source of heat by radiation and disposed above the upper wall of the inner compartment, the upper wall comprises at least one part made from a material which is transparent at least to infrared rays, such as a glass ceramic material.

8. The oven according to claim 1, wherein the heat generating means is an electrical resistance element.

9. The oven as claimed in claim 1, wherein the heat generating means rotates by at least 360° around the inner compartment according to an axis xx' perpendicular to the back.

10. An oven comprising:

an inner compartment comprising side walls, a lower wall, an upper wall, and a back, an outer compartment defining a casing and surrounding the inner compartment in order to delimit therewith a continuous intermediate space, heat generating means for producing heat by conduction, convection, or radiation connected to the casing and mounted between the inner compartment and the outer compartment, a source of energy, with the exception of sources of microwaves, connected to the heat generating means, the heat generating means being mounted so as to be movable relative to the casing and to the heating zone, the inner and outer compartments being substantially concentric and the heat generating means being mounted so that the heat generating means rotates between the inner compartment and the outer compartment, wherein the heat generating means is mounted so that the heat generating means rotates above the upper wall of the inner compartment about an axis yy' perpendicular to the lower wall.

11. The oven as claimed in claim 10, wherein the heat generating means is equipped with at least one movable burner element having a radiant surface which is movable therewith in order to radiate towards the at least one heating zone.

12. The oven as claimed in claim 10, wherein the heat generating means also comprises a fixed radiating element having a radiant surface opposite which the heat generating means is disposed in a predetermined position thereof to radiate, in this position of the heat generating means, towards the heating zone.

13. The oven as claimed in claim 12, wherein the fixed radiating element is a metal plate used as supplementary source of heat by radiation and disposed above the upper wall of the inner compartment, the upper wall comprises at least one part made from a material which is transparent at least to infrared rays, such as a glass ceramic material.

14. The oven as claimed in claim 10, wherein the heat generating means is equipped with at least one movable electrical resistance element having a radiant surface which is movable therewith in order to radiate towards the at least one heating zone.

15. An oven, comprising:

an inner compartment comprising side walls, a lower wall, an upper wall, and a back, an outer compartment defining a casing and surrounding the inner compartment in order to delimit therewith a continuous intermediate space, heat generating means for producing heat by conduction, convection or radiation, at least one heating zone adapted to be heated by the heat generating means, the heat generating means being movable relative to the casing and to the heating zone and being connected to a support of said casing so that it rotates between the inner compartment and the outer compartment, a source of energy, connected to said heat generating means, wherein the heat generating means is adapted to rotate above the upper wall about a third axis perpendicular to the lower wall and is equipped with at least one heating part having a radiant surface which is movable therewith in order to radiate towards the heating zone.

16. The oven as claimed in claim 15, also comprising a fixed heating element having a radiant surface in front of the heat generating means when disposed in a predetermined position thereof, the fixed heating element radiating, in this position of the heat generating means, towards the heating zone.

17. The oven as claimed in claim 16, wherein the fixed heating element is a metal plate used as a supplementary source of heat by radiation and disposed above the upper wall and the heat generating means, the upper wall comprising at least one part made from a material which is transparent at least to infrared rays.

18. An oven comprising:

an outer casing having a front wall provided with a door and a back wall opposite to said front wall, an inner compartment disposed within the outer casing and having an opening disposed so as to be closed by the door, the outer casing surrounding the inner compartment in order to delimit therewith a continuous intermediate space, heat generating means for producing heat by conduction, convection, or radiation connected to the casing and disposed between the inner compartment and the outer casing, in the intermediate space, a source of energy, with the exception of sources of microwaves, connected to the heat generating means to generate the heat, and a rotating arm on which the heat generating means is disposed so as to be movable relative to the outer casing and the inner compartment, wherein the rotating arm is fixed to the back of the outer casing and not to any other wall thereof so that the heat generating means rotates between the inner compartment and the outer casing around an axis perpendicular to said back.

* * * * *